United States Patent [19]

Peer

[11] Patent Number: 5,050,767

[45] Date of Patent: Sep. 24, 1991

[54] PERSONAL CONTAINER FOR SPECTATORS

[76] Inventor: Daniel Peer, 1460 Pepperell, Temperance, Mich. 48182

[21] Appl. No.: 599,289

[22] Filed: Oct. 17, 1990

[51] Int. Cl.[5] ..... B65D 25/24

[52] U.S. Cl. ..... 220/480; 220/476; 297/192; 297/275

[58] Field of Search ..... 297/192, 275; 220/480, 220/481, 482, 476

[56] References Cited

U.S. PATENT DOCUMENTS

| | | | |
|---|---|---|---|
| D. 190,778 | 6/1961 | Brooks | D67/4 |
| D. 195,589 | 6/1963 | Dales et al. | D67/4 |
| D. 239,429 | 4/1976 | Billingsley | D7/7 |
| D. 255,312 | 6/1980 | Uyeda | D7/76 |
| D. 256,630 | 9/1980 | Maney | D3/32 |
| D. 293,632 | 1/1988 | Capocasa | D6/336 |
| D. 298,186 | 10/1988 | Brannon | D6/336 |
| 1,621,536 | 3/1927 | Handte | 220/480 |
| 2,711,213 | 6/1955 | Owens | 155/188 |
| 2,740,466 | 4/1956 | Du Priest | 155/133 |
| 2,823,004 | 2/1958 | Melloh | 220/480 |
| 3,729,112 | 4/1973 | Lopatka | 220/480 |
| 4,556,250 | 12/1985 | Champman et al. | 297/192 |
| 4,652,048 | 3/1987 | Nazar | 297/192 |
| 4,936,480 | 6/1990 | Apostolo | 220/480 |

*Primary Examiner*—Joseph Man-Fu Moy

*Attorney, Agent, or Firm*—David C. Purdue; John C. Purdue

[57] ABSTRACT

A portable container device, particularly adapted for use by spectators in bleachers seats, is disclosed. The device comprises a container having a bottom, a top and four sides and a support bracket secured to the top of the container. The support bracket comprises upper and lower flanges adapted to be positioned above and below a bleacher seat. A depth flange is connected to and between the upper and lower flanges and serves to maintain them in substantially parallel relationship. The depth flange is located above the front wall, on the front side of the device. A pivotable support handle may be provided adjacent to the rear side of the device so that it can be pivoted between a rest position and a support position. In the support position, the handle supports the upper flange to maintain it in substantially parallel relationship to the lower flange, even for example, when a person is seated upon the upper flange. A cushioned seat may be provided on the top of the upper flange for comfort.

12 Claims, 2 Drawing Sheets

PERSONAL CONTAINER FOR SPECTATORS

BACKGROUND OF THE INVENTION

1. Field of the Invention

This invention relates to the field of portable containers of a type particularly suited for use by spectators at events for which there is bleacher seating or the like. Specifically, the invention is concerned with a container, insulated or not, which can be supported under a bleacher to keep possessions accessible but out of the way during such events.

2. Description of the Prior Art

Insulated containers (coolers) are well known for keeping beverages and perishable items cold without refrigeration. A conventional type of cooler has a bottom, four sides and a removable top which are insulated and one or more handles for carrying purposes. Such an arrangement is shown in U.S. Pat. No. Des. 256,630 in combination with shoulder straps. A similar cooler is disclosed in U.S. Pat. No. Des. 239,429.

Also known are insulated coolers with integral tops and bottoms and four sides wherein one of the sides constitutes or includes a door or other means of ingress. Examples are shown in U.S. Pat. Nos. Des. 195,489 and 255,312.

Coolers designed to function as coolers and as seats are known. The aforementioned U.S. Pat. No. Des. 256,630 discloses a cooler with a seat formed on the top. A cooler with a hinged lid which constitutes a seat, when it is closed, is disclosed in U.S. Pat. No. Des. 298,186. U.S. Pat. No. Des. 293,632 discloses a cooler with an integral top which constitutes a seat and a door/panel on a front side.

U.S. Pat No. Des. 190,778 discloses a combined cooler and bracketed support. The support member has a basket type arrangement for holding a cooler and a bracket for securing the support member to a separate rigid member. A cooler including brackets for supporting it behind an automobile seat is disclosed in U.S. Pat. No. 2,711,213.

A collapsible stadium seat is disclosed in U.S. Pat. No. 2,740,466. The seat comprises a seat frame member with a back frame member pivotally connected thereto along a first edge of the seat frame and a foot bag is pivotally connected to the seat bottom at an edge opposite the first edge. The foot bag is zippered on the front side. A pair od hooks are provided on the bottom of the seat frame for engaging a stadium seat.

A portable chair is disclosed in U.S. Pat. No. 4,652,048. The seat of the chair is comprised of an insulated container with a removable front panel.

Finally, U.S. Pat. No. discloses a container/article holder for stadium-type chairs. The container has a top, a bottom, and four sides. The front side is hingedly connected to the container on an upper edge and is provided with zippers to secure it to the container on the other three sides. A flexible three sided sleeve is secured to the container along two opposed sides of the container and to the top of the container near the front side, and is open on a fourth side. Thus, the sleeve is adapted to be slid, open side first, over the seat portion of a stadium seat, with the fourth side of the container facing forward.

There remains a need, particularly for spectators who sit in bleachers, many of which are open, except for a foot board, so that items can fall to the ground, for a suitable device for storing articles safely and securely but which will not interfere with space needed and intended for the spectator and those seated around the spectator.

DETAILED DESCRIPTION OF THE PREFERRED EMBODIMENT

Figure 1:
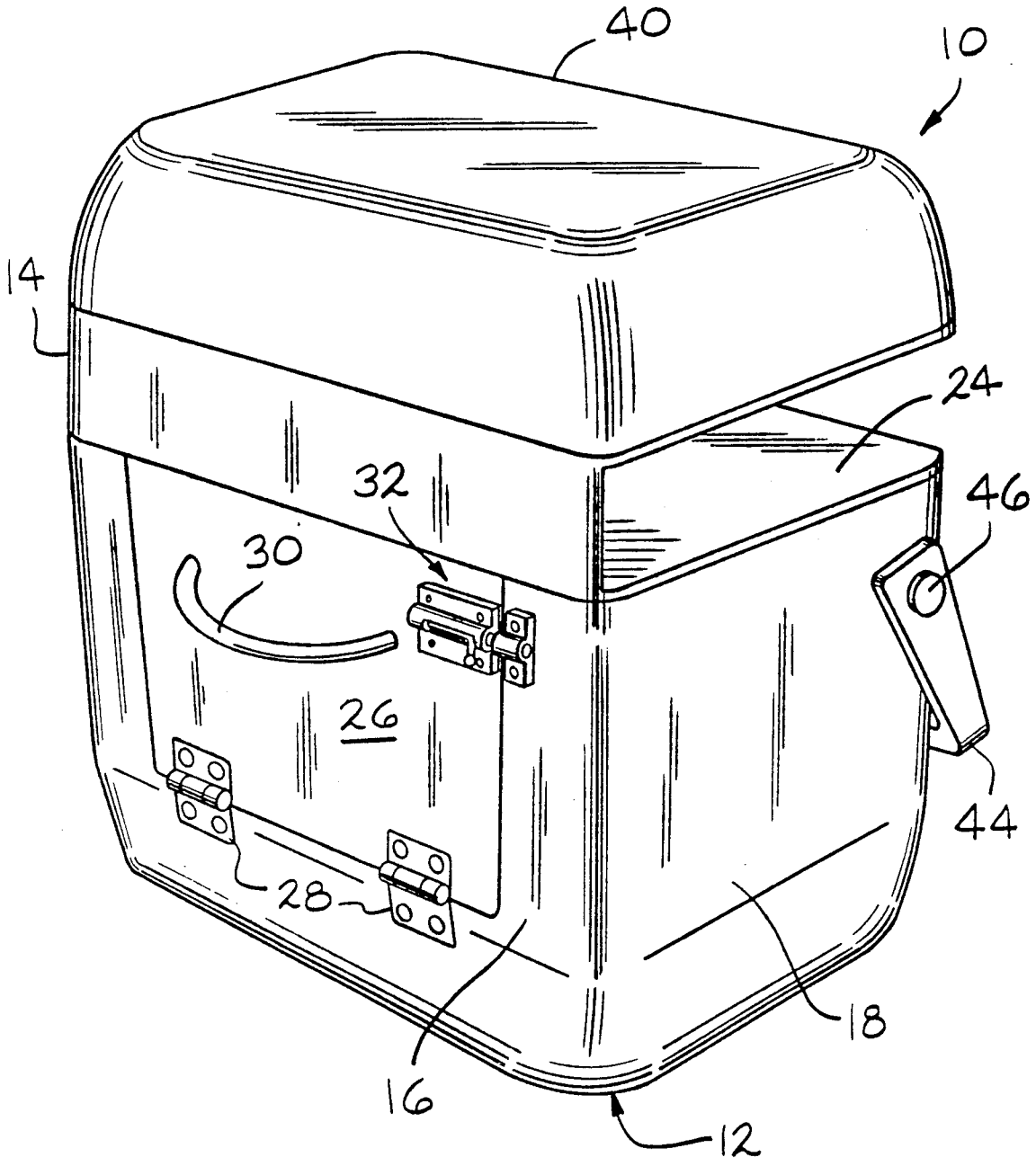
FIG. 1 is a perspective view of a container according to the present invention.

With reference to FIG. 1, a device according to the invention is indicated generally at 10. The device 10 essentially comprises a container 12 and a rigid support bracket 14. The container 12, in turn, comprises a front wall 16, a first side wall 18, a second side wall (not visible in the drawing figures but corresponds with side wall 18) opposite said first side wall 18, a rear wall 20 (FIG. 3) opposite the front wall 16, a bottom 22 (FIG. 3) and a top 24. A door 26 is provided in the front wall 16 and is pivotally supported thereon by hinges 28. A handle 30 is provided to facilitate movement of the door 26 between a closed (illustrated) position and an open position as shown in phantom lines in FIG. 3. A known latch mechanism 32 is provided to secure the door 26 in the closed position, when desired. In the illustrated embodiment, the front and rear walls 16 and 20, the first and second side walls 18 and the bottom 22 are insulated, i.e., they are composed of thermally insulating material such as foam. Other materials may be employed to achieve desirable results.

The support bracket 14 comprises an upper flange 34 (FIG. 3), a lower flange 36 and a depth flange 38. In the illustrated embodiment, the lower flange 36 and the top 24 of the container 12 are one in the same. It will be understood that a lower flange (not illustrated) separate from a top of the container 12 may be provided. In that case, the lower flange would be secured to the top. In the illustrated embodiment, the upper flange 34 is secured to the upper edges of the front and rear walls 16 and 20 and the side walls 18 by adhesive (not shown) although other suitable means may be employed.

Figure 2:
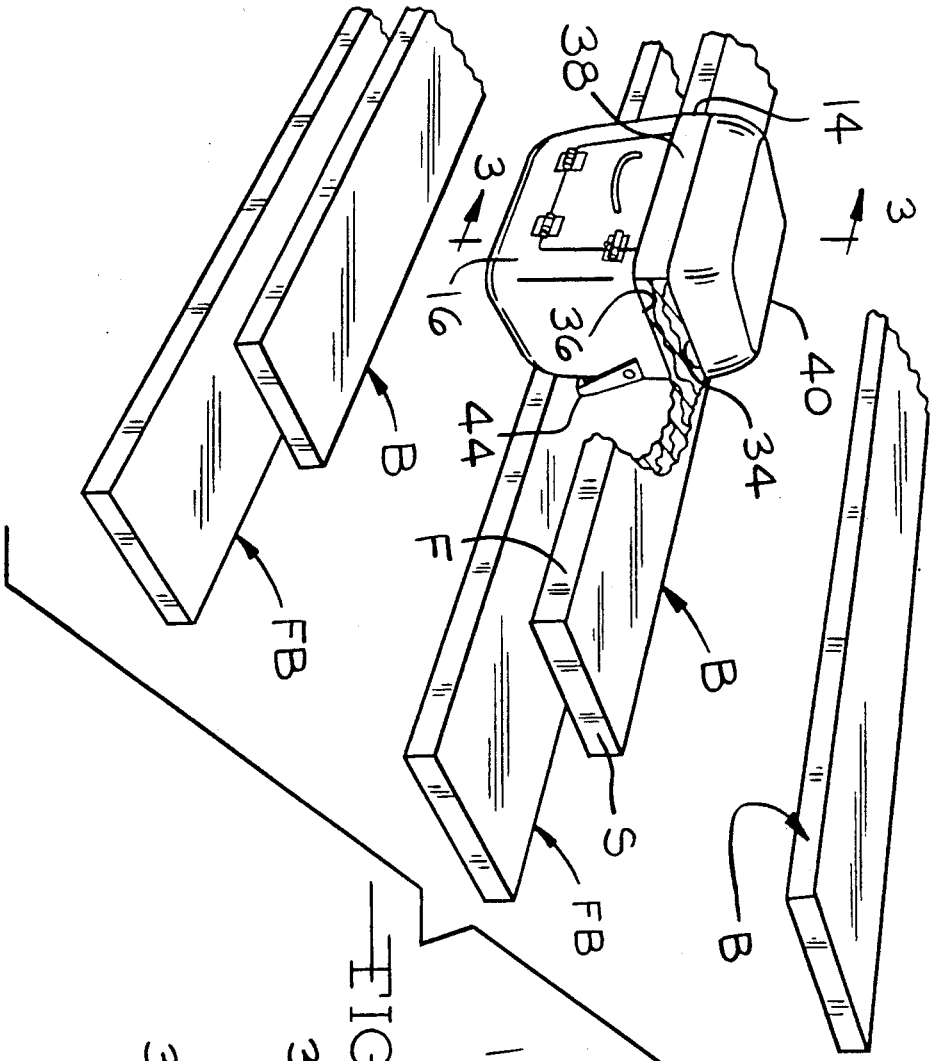
FIG. 2 is a perspective view of a container according to the invention, supported on a bleacher seat.

The depth flange 38 is connected to and extends between the upper and lower flanges 34 and 36 and rigidly supports them in substantially parallel relationship to each other, spaced apart a distance sufficient to enable the support bracket 14 to be supported on a bleacher seat B having a front F and a side S, as shown in FIG. 2. The bleacher arrangement shown in FIG. 2 is fairly common and comprises bleacher seats B and foot boards FB. It will be appreciated that, absent a device according to the present invention, bleacher seating provides virtually no accommodation for occupants to stow personal belongings. The device 10 is substantially flush with the front F of the bleacher seat B so that when the device is mounted as shown in FIG. 2, it will not interfere with a spectator's use of the bleacher seat B. The upper and lower flanges 34 and 36 extend rearwardly from the depth flange 38 a distance corresponding substantially with the length of the side S of the bleacher seat B so that the device does not extend past the rear of the bleacher seat B and does not, therefor, infringe upon the space which "belongs" to the seat located immediately behind the seat on which the device 10 is mounted.

An upholstered seat 40 comprising a cushion 41 and a cover 42 is provided on the upper flange 34 and suitably secured thereto, for example, by adhesive (not shown). In a bleacher application, such as the one illustrated in FIG. 2, the upper flange 34 is supported on the bleacher seat B and the cushion 41 is, in turn, supported on the upper flange 34. The depth flange 38 connects the upper and lower flanges 34 and 36 and maintains them in substantially parallel relationship against the moment caused by the container through the line along which the depth flange 38 is connected to the lower flange 36. Accordingly, the depth flange 38 and the upper and lower flanges 34 and 36 must have sufficient rigidity to maintain the substantially parallel relationship between the upper and lower flanges 34 and 36 when the device 10 is supported on a bleacher seat B. It has been determined that galvanized sheet steel having a uniform thickness of 125 mils (one eighth of an inch) provides adequate resistance to the bending moment associated with the container 12 supported beneath a bleacher and holding a payload weighing up to approximately fifteen or twenty pounds. It is preferred, for economy of manufacture, to produce the support bracket 14 comprising the depth flange 38 and the upper and lower flanges 34 and 36 from a single piece of sheet metal.

Figure 3:
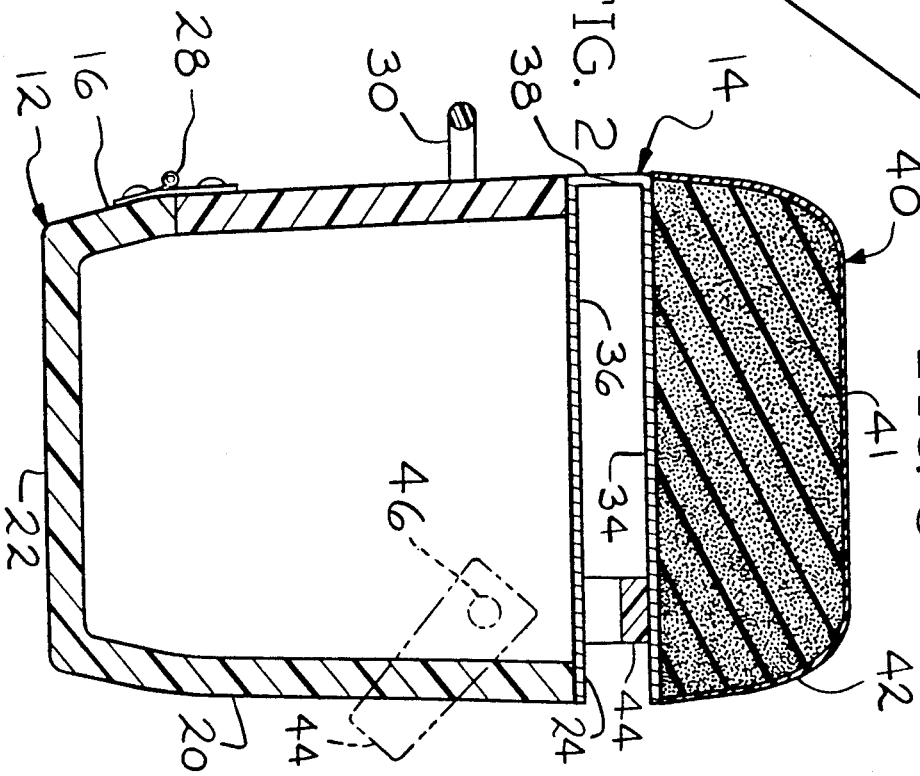
FIG. 3 is a sectional view of the container, taken along the line 3—3 in FIG. 2.

Referring now to FIGS. 1 and 3, a handle 44 of suitable material, such as a molded plastic, is pivotally supported by posts 46 which extend into apertures (not shown) in the side wall 18 and the opposed side wall. The handle 14 can be pivoted between a first, bleacher position shown in FIGS. 1 and 2 (and in phantom lines in FIG. 3) and a second, stand alone position illustrated in FIG. 3 where the handle contacts the upper flange 34. In the second position, the handle 44 supports the upper flange 34 relative to the container 12 so that the upper and lower flanges 34 and 36 will retain their substantially parallel relationship when someone is seated upon the seat 40. Thus, the device 10 can be place with the container 12 on the ground and the handle 44 in the stand alone postion and be used as a seat.

Thus, it will be seen that the instant invention provides an elegantly simple solution for spectators who need a way to stow belongings during an event for which there is bleacher seating. Although the foregoing description will enable those skilled in the art to make and use the invention, it will be appreciated that various modifications can be made thereto without departing from the spirit and scope of the invention as defined in the following claims.

I claim:

1. A device for supporting personal articles beneath a stadium bleacher, or the like, having a front edge and a given thickness, said device comprising a container including front and rear walls having upper and lower ends, first and second opposed side walls having upper and lower ends, a bottom connected to the lower ends of said front, rear and first side and second side walls, a rigid support bracket comprising upper and lower flanges and a depth flange connected to said upper and lower flanges and rigidly supporting them in substantially parallel relationship to each other spaced apart a distance equal to or greater than the given thickness, and means connecting said lower flange to said container along or adjacent to said upper ends of said front, rear and first and second side walls so that said depth flange is positioned opposite said rear wall, wherein said bracket is operable to support said container under the stadium bleacher, or the like, with said upper flange above the bleacher, said lower flange beneath the bleacher and said depth flange adjacent to the front edge of the stadium bleacher, or the like.

2. The device claimed in claim 1 wherein the front wall includes a door movable between a first, open position and a second, closed position.

3. The device claimed in claim 2 wherein the container is composed of insulative material(s).

4. The device claimed in claim 1 which additionally includes a support handle pivotally mounted on the container adjacent to the rear wall for pivotal movement between a support position and a rest position so that, in the former position, it is operable to support the upper flange, relative to the container, in a substantially parallel position relative to the lower flange.

5. A device for supporting personal articles beneath a stadium bleacher, or the like, having a given thickness, said device comprising an insulated container including front and rear walls having upper and lower ends, first and second opposed side walls having upper and lower ends, a bottom connected to the lower ends of said front, rear and first side and second side walls, a rigid support bracket comprising upper and lower flanges and a depth flange connected to said upper and lower flanges and rigidly supporting them in substantially parallel relationship to each other spaced apart a distance equal to or greater than the given thickness, said support bracket being formed of a single piece of rigid material, means connecting said lower flange to said container along or adjacent to said upper ends of said front, rear and first and second side walls so that said depth flange is positioned opposite said rear wall, wherein said bracket is operable to support said container under the stadium bleacher, or the like, with said upper flange above the bleacher, said lower flange beneath the bleacher and said depth flange adjacent to the front edge of the stadium bleacher, or the like.

6. The device claimed in claim 5 wherein the front wall includes a door movable between a first, open position and a second, closed position.

7. The device claimed in claim 5 which additionally includes a support handle pivotally mounted on the container adjacent to the rear wall for pivotal movement between a support position and a rest position so that, in the former position, it is operable to support the upper flange, relative to the container, in a substantially parallel position relative to the lower flange.

8. The device claimed in claim 6 which additionally includes a support handle pivotally mounted on the container adjacent to the rear wall for pivotal movement between a support position and a rest position so that, in the former position, it is operable to support the upper flange, relative to the container, in a substantially parallel position relative to the lower flange.

9. A device for supporting personal articles beneath a stadium bleacher, or the like, having a given thickness, said device comprising a container including front and rear walls having upper and lower ends, first and second opposed side walls having upper and lower ends, a bottom connected to the lower ends of said front, rear and first side and second side walls, a rigid support bracket comprising upper and lower flange means for supporting said container relative to a horizontally oriented bleacher set, and depth flange means for connecting said upper and lower flange means and rigidly supporting them in substantially parallel relationship to each other spaced apart a distance equal to or greater than the given thickness, and means connecting said lower flange means to said container along or adjacent to said upper ends of said front, rear and first and second side walls so that said depth flange means are positioned opposite said rear wall, wherein said bracket is operable to support said container under the stadium bleacher, or the like, with said upper flange means above the bleacher, said lower flange means beneath the bleacher and said depth flange means adjacent to the front edge of the stadium bleacher, or the like.

10. The device claimed in claim 9 wherein the front wall includes a door movable between a first, open position and a second, closed position.

11. The device claimed in claim 9 wherein the container is composed of insulative material(s).

12. The device claimed in claim 9 which additionally includes a support handle pivotally mounted on the container adjacent to the rear wall for pivotal movement between a support position and a rest position so that, in the former position, it is operable to support the upper flange means, relative to the container, in a substantially parallel position relative to the lower flange means.

* * * * *